US011313328B2

(12) United States Patent
Ogasawara et al.

(10) Patent No.: US 11,313,328 B2
(45) Date of Patent: Apr. 26, 2022

(54) FUEL SUPPLY SYSTEM FOR ENGINE WARM-UP

(71) Applicant: Walbro LLC, Tucson, AZ (US)

(72) Inventors: Hiroki Ogasawara, Ogawara-Machi (JP); Tsuyoshi Watanabe, Shibata-county (JP)

(73) Assignee: Walbro LLC, Cass City, MI (US)

( * ) Notice: Subject to any disclaimer, the term of this patent is extended or adjusted under 35 U.S.C. 154(b) by 226 days.

(21) Appl. No.: 16/089,103

(22) PCT Filed: Mar. 28, 2017

(86) PCT No.: PCT/US2017/024420

§ 371 (c)(1),
(2) Date: Sep. 27, 2018

(87) PCT Pub. No.: WO2017/172682

PCT Pub. Date: Oct. 5, 2017

(65) Prior Publication Data

US 2019/0113004 A1 Apr. 18, 2019

Related U.S. Application Data

(60) Provisional application No. 62/314,045, filed on Mar. 28, 2016.

(51) Int. Cl.
*F02M 1/10* (2006.01)
*F02M 1/08* (2006.01)
(Continued)

(52) U.S. Cl.
CPC ..... *F02M 1/10* (2013.01); *F02D 41/064* (2013.01); *F02D 41/067* (2013.01); *F02M 1/08* (2013.01); *F02B 25/10* (2013.01); *F02M 17/04* (2013.01)

(58) Field of Classification Search
CPC ..... F02D 41/067; F02D 41/064; F02B 25/10; F02M 1/08; F02M 17/04; F02M 1/10
See application file for complete search history.

(56) References Cited

U.S. PATENT DOCUMENTS 1,828,800 A * 10/1931 Federle ..... F02M 1/16 123/179.7
4,246,639 A * 1/1981 Carp ..... F02D 41/266 701/123

(Continued)

FOREIGN PATENT DOCUMENTS

CN 1869422 A 11/2006
CN 1896483 A 1/2007

(Continued)

OTHER PUBLICATIONS

Written Opinion & International Search Report for PCT/US2017/024420 dated Jun. 27, 2017, 16 pages.

(Continued)

*Primary Examiner* — Stephen Hobson
(74) *Attorney, Agent, or Firm* — Reising Ethington P.C.; Matthew J. Schmidt

(57) ABSTRACT

In at least one implementation, a method of operating a combustion engine, includes determining a temperature equal or related to a temperature of an engine at an engine start and comparing the determined temperature to a temperature threshold, determining if an engine operating condition exceeds an engine threshold within a threshold time after the engine was started, and if the determined temperature is below the threshold temperature and the engine operating condition remains above the engine threshold and the threshold time has not passed, providing an enriched fuel and air mixture to the engine.

18 Claims, 5 Drawing Sheets

(51) Int. Cl.

| | |
|---|---|
| ***F02D 41/06*** | (2006.01) |
| *F02M 17/04* | (2006.01) |
| *F02B 25/10* | (2006.01) |

(56) References Cited

U.S. PATENT DOCUMENTS

| | | | | |
|---|---|---|---|---|
| 4,393,012 | A * | 7/1983 | Kato | F02M 1/10 60/527 |
| 4,498,434 | A * | 2/1985 | Baltz | F02M 1/16 261/DIG. 8 |
| 5,560,345 | A | 10/1996 | Geyer et al. | |
| 5,605,138 | A | 2/1997 | Deichsel et al. | |
| 5,817,923 | A | 10/1998 | Ohsaki et al. | |
| 6,079,396 | A * | 6/2000 | Ament | F02D 41/047 123/491 |
| 6,415,766 | B1 * | 7/2002 | Kanno | F02D 31/008 123/339.22 |
| 7,000,595 | B2 | 2/2006 | Andersson et al. | |
| 7,028,993 | B2 | 4/2006 | Burns | |
| 7,246,591 | B2 | 7/2007 | Shinogi et al. | |
| 7,509,941 | B2 | 3/2009 | Ottosson et al. | |
| 8,622,031 | B2 * | 1/2014 | Watanabe | F02M 7/12 123/438 |
| 2004/0173195 | A1 | 9/2004 | Ament | |
| 2004/0182366 | A1 | 9/2004 | Andersson et al. | |
| 2005/0098907 | A1 | 5/2005 | Richard et al. | |
| 2005/0279326 | A1 * | 12/2005 | Andersson | F02P 5/1506 123/406.47 |
| 2006/0102126 | A1 | 5/2006 | Nakata et al. | |
| 2007/0028881 | A1 | 2/2007 | Nakata et al. | |
| 2009/0013951 | A1 | 1/2009 | Nakata et al. | |
| 2009/0044777 | A1 | 2/2009 | Clouse et al. | |
| 2009/0107441 | A1 | 4/2009 | Husak et al. | |
| 2010/0011597 | A1 | 1/2010 | Bo et al. | |
| 2011/0253102 | A1 | 10/2011 | Watanabe et al. | |
| 2013/0255629 | A1 | 10/2013 | Yamashita et al. | |
| 2015/0020772 | A1 | 1/2015 | Eberle et al. | |
| 2015/0198129 | A1 | 7/2015 | Dangelmaier et al. | |
| 2015/0252772 | A1 | 9/2015 | Nishio et al. | |
| 2015/0308331 | A1 | 10/2015 | Song et al. | |
| 2018/0128196 | A1 * | 5/2018 | Gottlieb | F02P 5/1506 |

FOREIGN PATENT DOCUMENTS

| | | | |
|---|---|---|---|
| CN | 203769965 | U | 8/2014 |
| EP | 1744038 | A1 | 1/2007 |
| WO | WO03071120 | A1 | 8/2003 |
| WO | WO2012002859 | A1 | 1/2012 |

OTHER PUBLICATIONS

Swedish Search Report in Swedish Patent App. No. 1851197-2 dated May 17, 2019 (4 pages).

CN Office Action for CN Application No. 201780021416.3 dated May 13, 2020 (12 pages).

CN Office Action for CN Application No. 201780021416.3 dated May 7, 2021 (13 pages).

* cited by examiner

FUEL SUPPLY SYSTEM FOR ENGINE WARM-UP

REFERENCE TO RELATED APPLICATIONS

This application claims the benefit of U.S. Provisional Application Ser. No. 62/314,045 filed on Mar. 28, 2016, the entire contents of which are incorporated herein by reference.

TECHNICAL FIELD

The present disclosure relates generally to a system for supplying fuel to an engine to improve operation of an engine after initial starting of the engine.

BACKGROUND

Cold-starting and warm-up of internal combustion engines, particularly small engines in chainsaws, snowblowers, outboard marine engines, ATV's, two-wheel vehicles and the like, have been and remain a problem in the art. Engine stability can be problematic when a cold engine is initially started. Some systems provide supplemental fuel to the engine upon starting and without regard to operating conditions like engine speed and temperature. Such supplemental fuel can be problematic in at least certain engine operating conditions. For example, providing additional fuel to an engine that is already being supplied with a rich fuel and air mixture and is struggling to stably operate after starting, and which may be close to stalling, can negatively impact engine operation and/or cause the engine to stall. Thus, there is a need for, among other things, an automatic engine enrichment system for use with internal combustion engines of the described character that is automatically responsive to engine operation and operating conditions to selectively enrich the fuel and air mixture delivered to the engine.

SUMMARY

In at least one implementation, a method of operating a combustion engine, includes determining a temperature equal or related to a temperature of an engine at an engine start and comparing the determined temperature to a temperature threshold, determining if an engine operating condition exceeds an engine threshold within a threshold time after the engine was started, and if the determined temperature is below the threshold temperature and the engine operating condition remains above the engine threshold and the threshold time has not passed, providing an enriched fuel and air mixture to the engine. In at least some implementations, the engine threshold includes an engine speed that is at least 1,000 rpm greater than the nominal idle speed of the engine. In at least some implementations, the engine threshold includes an engine speed that is between 3,500 rpm and wide open throttle engine operation. In at least some implementations, the engine threshold includes an engine speed that is at least 25% greater than the nominal idle speed of the engine.

In at least some implementations, the threshold time is between 10 and 200 seconds, and/or the threshold temperature is between −5° C. and 15° C.

In at least some implementations, the step of providing an enriched fuel and air mixture to the engine may be accomplished as a function of at least one of the time since the engine was started and the difference between the determined temperature and the threshold temperature. In at least some implementations, the closer in time to engine starting and the larger the difference between the determined temperature and the threshold temperature, the longer the enriched fuel and air mixture may be supplied to the engine.

In at least some implementations, the step of providing an enriched fuel and air mixture may include opening a valve associated with a charge forming device to provide additional fuel into a fuel and air mixture provided from the charge forming device than is provided when the valve is closed. The valve may be selectively opened and closed during the threshold time when the engine speed is greater than a speed threshold. The valve may be repeatedly opened for a first period of time and closed the remainder of the time within the threshold time. The valve may be open for at least 10 percent of the engine revolutions within the threshold time. And the first period of time may include one or more engine revolutions and the second period of time may include a greater number of engine revolutions than the first period of time. In at least some implementations, the valve is open for at least 1 revolution out of every 10 to 100 revolutions. Instead of controlling fuel flow, the step of providing an enriched fuel and air mixture may include closing a valve associated with an air passage to reduce air within a fuel and air mixture delivered to the engine.

In at least some implementations, an enriched fuel and air mixture may be provided to the engine when the engine speed is below a speed threshold and the time since the engine started is less than a warm-up time threshold.

In at least some implementations, the fuel and air mixture is provided to the engine by a charge forming device having a throttle valve and the engine threshold relates to the position of the throttle valve relative to a position of the throttle valve when the engine is operating at a nominal engine idle speed. The engine operating condition may relate to engine stability which may be determined by checking cycle-to-cycle engine speed deviation and the engine threshold relates to a maximum cycle-to-cycle engine speed deviation.

In at least some implementations, a method of operating a combustion engine includes:

- determining a temperature equal to or related to a temperature of an engine at an engine start and comparing the determined temperature to a temperature threshold;
- determining if an engine speed exceeds an engine speed threshold within a threshold time after the engine was started; and
- if the determined temperature is below the threshold temperature and the engine speed is above the engine speed threshold and the threshold time has not passed, providing an enriched fuel and air mixture to the engine.

In at least some implementations, the engine speed threshold is at least 25% greater than a nominal idle speed of the engine. In at least some implementations, the threshold time is between 10 and 200 seconds and the threshold temperature is between −5° C. and 15° C.

BRIEF DESCRIPTION OF THE DRAWINGS

The following detailed description of preferred implementations and best mode will be set forth with regard to the accompanying drawings, in which.

DETAILED DESCRIPTION

Figure 1:
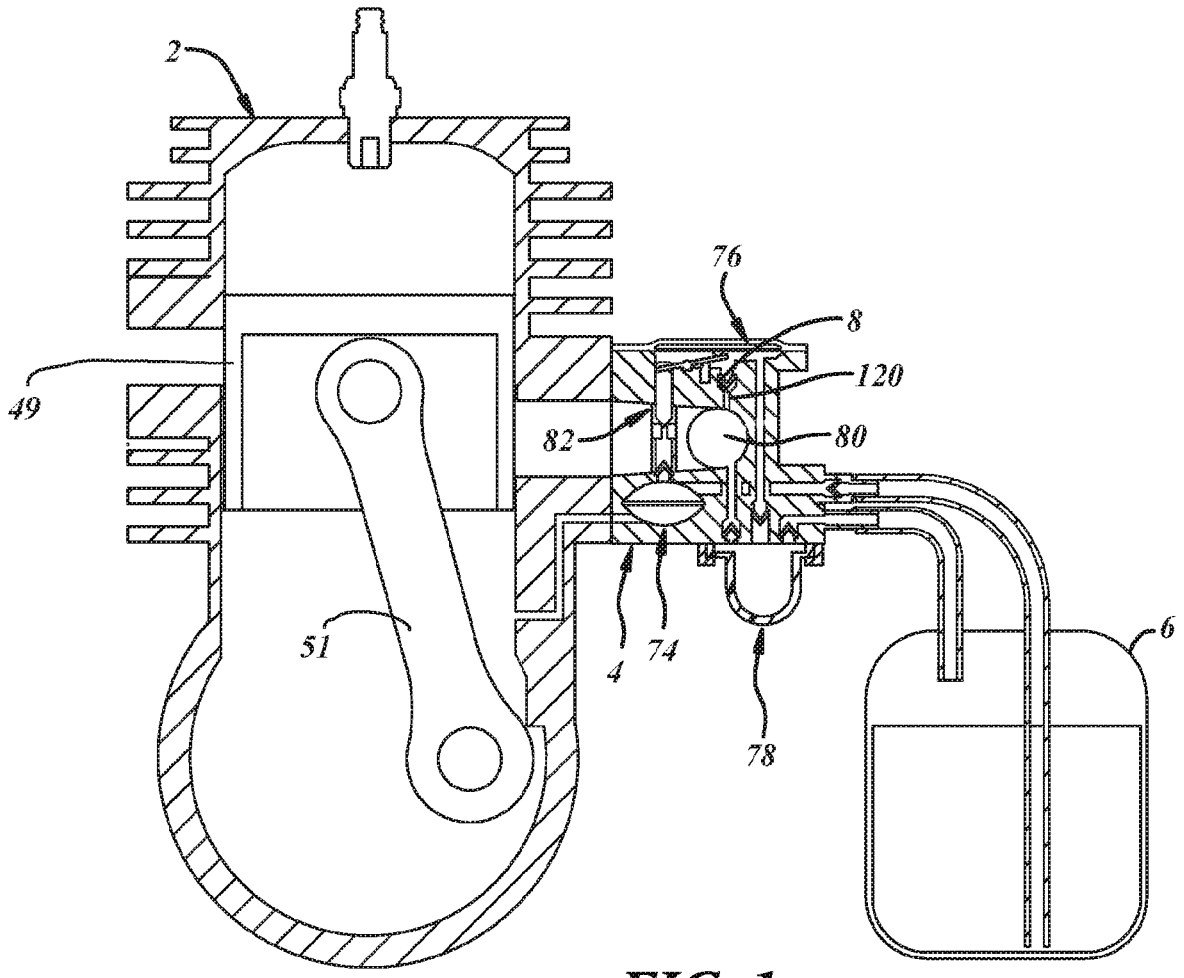
FIG. 1 is a schematic view of an engine and a carburetor including a fuel mixture control device.

Referring in more detail to the drawings, FIG. 1 illustrates an engine 2 and a charge forming device 4 that delivers a fuel and air mixture to the engine 2 to support engine operation. In at least one implementation, the charge forming device 4 includes a carburetor, and the carburetor may be of any suitable type including, for example, diaphragm and float bowl carburetors. A diaphragm-type carburetor 4 is shown in FIG. 1. The carburetor 4 takes in fuel from a fuel tank 6 and includes a mixture control device 8 capable of altering the air/fuel ratio of the fuel mixture delivered from the carburetor. During certain engine operating conditions, when the engine is relatively cold, has recently been started, and is operating above a threshold speed, the mixture control device 8 or some other component may be used to alter the fuel and air mixture, for example, to provide supplementary fuel resulting in delivery or an enriched fuel mixture to the engine to support warming up the engine. In at least some implementations, the threshold speed at which the enriched fuel mixture is provided is significantly above idle speed, so the system improves higher speed warming up of the engine, and this may be done for a limited duration or number of engine cycles after the engine has been started, as will be set forth in more detail below.

Figure 2:
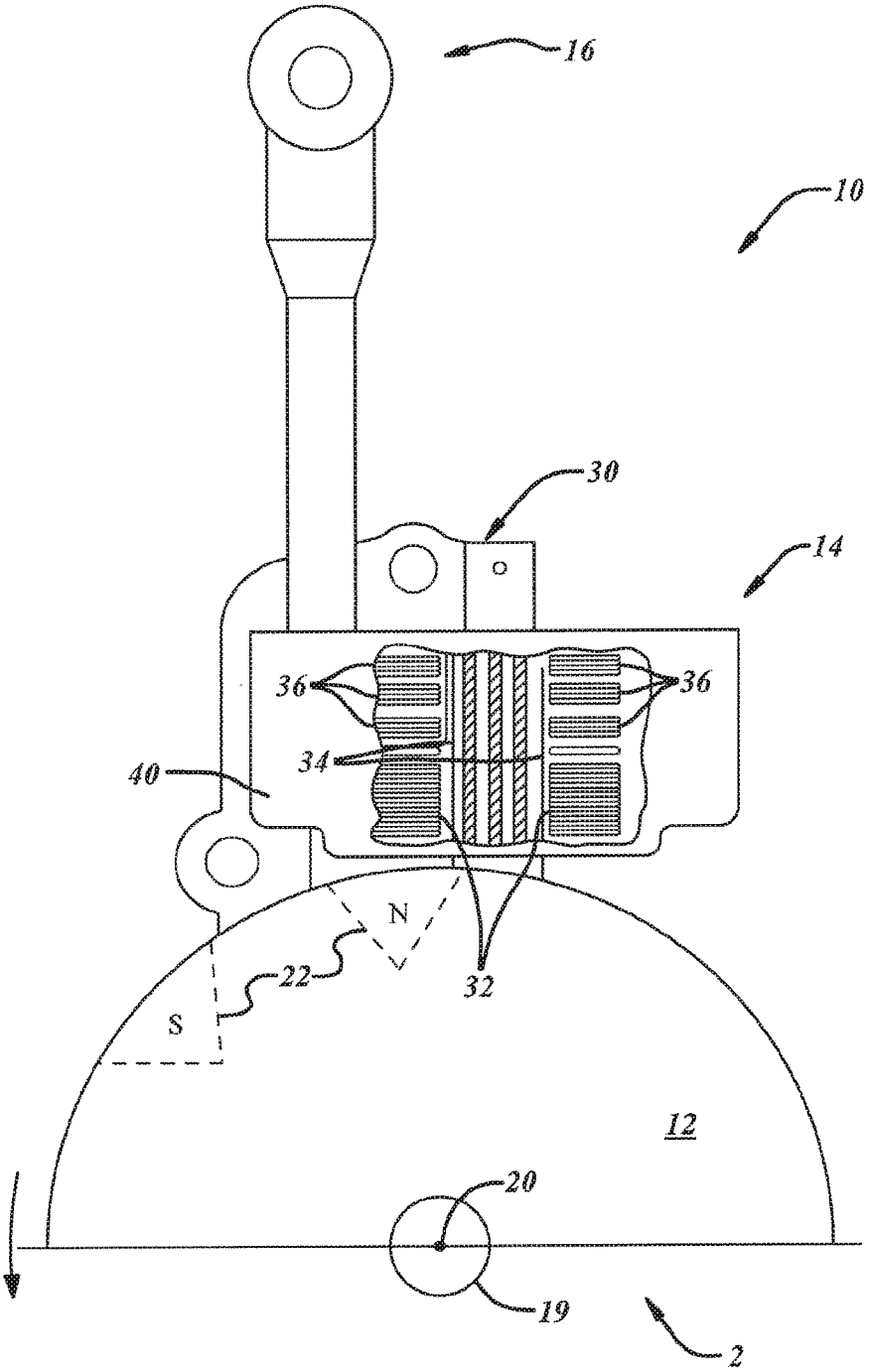
FIG. 2 is a fragmentary view of a flywheel and ignition components of the engine.
Figure 3:
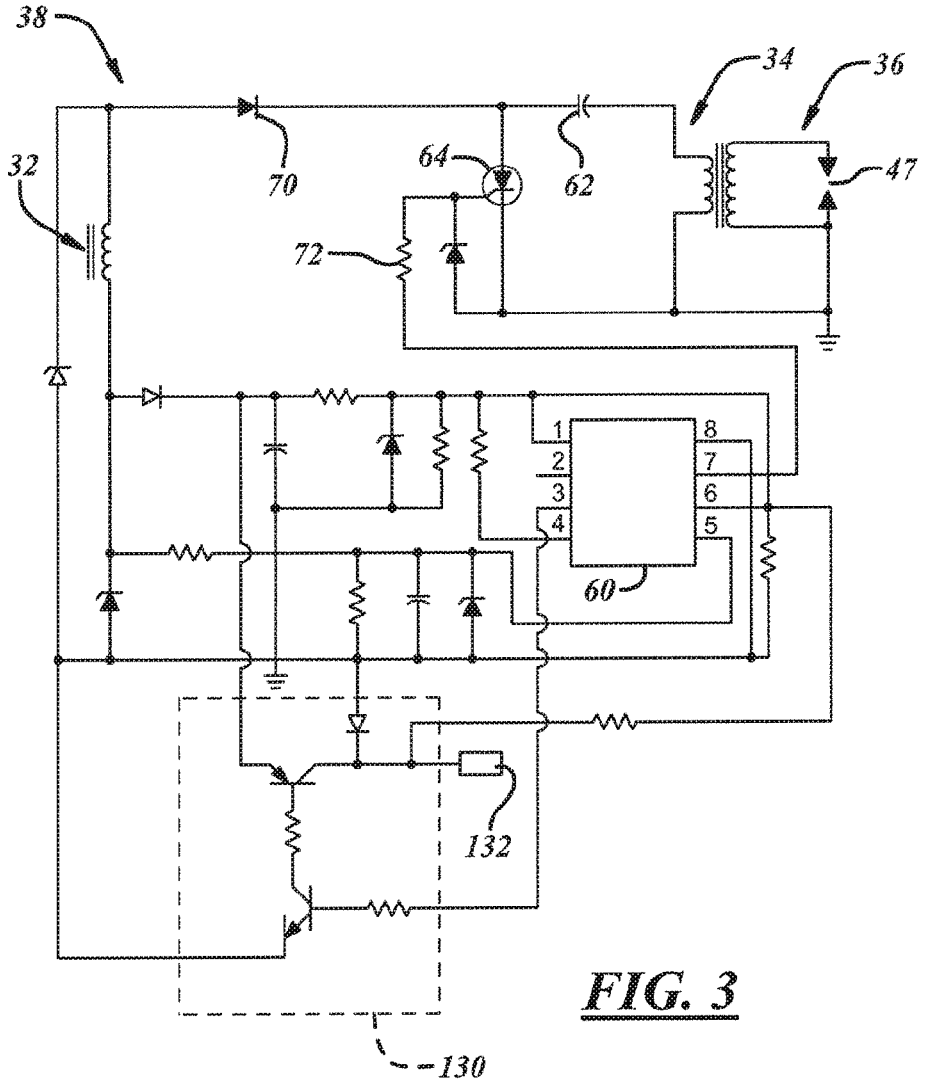
FIG. 3 is a schematic diagram of an ignition circuit.

The engine speed may be determined in a number of ways, one of which uses signals within an ignition system 10 such as may be generated by one or more magnets on a rotating flywheel 12. FIGS. 2 and 3 illustrate an exemplary signal generation or ignition system 10 for use with an internal combustion engine 2, such as (but not limited to) the type typically employed by hand-held and ground-supported lawn and garden equipment. Such equipment includes chainsaws, trimmers, lawn mowers, and the like. The ignition system 10 could be constructed according to one of numerous designs, including magneto or capacitive discharge designs, such that it interacts with an engine flywheel 12 and generally includes a control system 14, and an ignition boot 16 for connection to a spark plug (not shown).

The flywheel 12 rotates about an axis 20 under the power of the engine 2 and includes magnetic elements 22. As the flywheel 12 rotates, the magnets 22 spin past and electromagnetically interact with components of the control system 14 for sensing engine speed among other things.

The control system 14 includes a ferromagnetic stator core or lamstack 30 having wound thereabout a charge winding 32, a primary ignition winding 34, and a secondary ignition winding 36. The primary and secondary windings 34, 36 basically define a step-up transformer or ignition coil used to fire a spark plug. The control system also includes a circuit 38 (shown in FIG. 3), and a housing 40, wherein the circuit 38 may be located remotely from the lamstack 30 and the various windings. As the magnets 22 are rotated past the lamstack 30, a magnetic field is introduced into the lamstack 30 that, in turn, induces a voltage in the various windings. For example, the rotating magnets 22 induce a voltage signal in the charge winding 32 that is indicative of the number of revolutions of the engine 2 in the control system. The signal can be used to determine the rotational speed of the flywheel 12 and crankshaft 19 and, hence, the engine 2. Finally, the voltage induced in the charge winding 32 is also used to power the circuit 38 and charge an ignition discharge capacitor 62 in known manner. Upon receipt of a trigger signal, the capacitor 62 discharges through the primary winding 34 of the ignition coil to induce a stepped-up high voltage in the secondary winding 36 of the ignition coil that is sufficient to cause a spark across a spark gap of a spark plug 47 to ignite a fuel and air mixture within a combustion chamber of the engine.

In normal engine operation, downward movement of an engine piston 49 during a power stroke drives a connecting rod 51 that, in turn, rotates the crankshaft 19, which rotates the flywheel 12. As the magnets 22 rotate past the lamstack 30, a magnetic field is created which induces a voltage in the nearby charge winding 32 which is used for several purposes. First, the voltage may be used to provide power to the control system 14, including components of the circuit 38. Second, the induced voltage is used to charge the main discharge capacitor 62 that stores the energy until it is instructed to discharge, at which time the capacitor 62 discharges its stored energy across primary ignition winding 34. Lastly, the voltage induced in the charge winding 32 is used to produce an engine speed input signal, which is supplied to a microcontroller 60 of the circuit 38. This engine speed input signal can play a role in the operation of the ignition timing, as well as controlling an air/fuel ratio of a fuel mixture delivered to the engine, as set forth below.

Referring now primarily to FIG. 3, the control system 14 includes the circuit 38 as an example of the type of circuit that may be used to implement the ignition timing control system 14. However, many variations of this circuit 38 may alternatively be used without departing from the scope of the invention. The circuit 38 interacts with the charge winding 32, primary ignition winding 34, and preferably a kill switch, and generally comprises the microcontroller 60, an ignition discharge capacitor 62, and an ignition thyristor 64.

The microcontroller 60 as shown in FIG. 3 may be an 8-pin processor, which utilizes internal memory or can access other memory to store code as well as for variables and/or system operating instructions. Any other desired controllers, microcontrollers, or microprocessors may be used, however. Pin 1 of the microcontroller 60 is coupled to the charge winding 32 via a resistor and diode, such that an induced voltage in the charge winding 32 is rectified and supplies the microcontroller with power. Also, when a voltage is induced in the charge winding 32, as previously described, current passes through a diode 70 and charges the ignition discharge capacitor 62, assuming the ignition thyristor 64 is in a non-conductive state. The ignition discharge capacitor 62 holds the charge until the microcontroller 60 changes the state of the thyristor 64. Microcontroller pin 5 is coupled to the charge winding 32 and receives an electronic signal representative of the engine speed. The microcontroller uses this engine speed signal to select a particular operating sequence, the selection of which affects the desired spark timing. Pin 7 is coupled to the gate of the thyristor 64 via a resistor 72 and transmits from the microcontroller 60 an ignition signal which controls the state of the thyristor 64. When the ignition signal on pin 7 is low, the thyristor 64 is nonconductive and the capacitor 62 is allowed to charge. When the ignition signal is high, the thyristor 64 is conductive and the capacitor 62 discharges through the primary winding 34, thus causing an ignition pulse to be induced in the secondary winding 36 and sent on to the spark plug 47. Thus, the microcontroller 60 governs the discharge of the capacitor 62 by controlling the conductive state of the thyristor 64. Lastly, pin 8 provides the microcontroller 60 with a ground reference.

To summarize the operation of the circuit, the charge winding 32 experiences an induced voltage that charges ignition discharge capacitor 62, and provides the microcontroller 60 with power and an engine speed signal. The microcontroller 60 outputs an ignition signal on pin 7, according to the calculated ignition timing, which turns on the thyristor 64. Once the thyristor 64 is conductive, a current path through the thyristor 64 and the primary winding 34 is formed for the charge stored in the capacitor 62. The current discharged through the primary winding 34 induces a high voltage ignition pulse in the secondary winding 36. This high voltage pulse is then delivered to the spark plug 47 where it arcs across the spark gap thereof, thus igniting an air/fuel charge in the combustion chamber to initiate the combustion process.

As noted above, the microcontroller 60, or another controller, may play a role in altering an air/fuel ratio of a fuel mixture delivered by the carburetor 4 (for example) to the engine 2. In the embodiment of FIG. 1, the carburetor 4 is a diaphragm type carburetor with a diaphragm fuel pump assembly 74, a diaphragm fuel metering assembly 76, and a purge/prime assembly 78, the general construction and function of each of which is well-known. The carburetor 4 includes a fuel and air mixing passage 80 that receives air at an inlet end and fuel through a fuel circuit 82 supplied with fuel from the fuel metering assembly 76. The fuel circuit 82 includes one or more passages, port and/or chambers formed in a carburetor main body. One example of a carburetor of this type is disclosed in U.S. Pat. No. 7,467,785, the disclosure of which is incorporated herein by reference in its entirety. The mixture control device 8 is operable to alter the flow of fuel in at least part of the fuel circuit to alter the air/fuel ratio of a fuel mixture delivered from the carburetor 4 to the engine to support engine operation as commanded by a throttle.

In one form, and as noted above, the mixture control device that is used to change the air/fuel ratio as noted above includes a valve 8 that interrupts or inhibits and selectively permits a fluid flow within the carburetor 4. In at least one implementation, the valve 8 may be moved to an open position to permit to increase the fuel flow rate from the carburetor 4 and thereby enrich the fuel and air mixture delivered from the carburetor to the engine. The valve may be electrically controlled and actuated. An example of such a valve is a solenoid valve. The valve 8 may be reciprocated between open and closed positions when the solenoid is actuated. In one form, the valve prevents or at least inhibits fuel flow through a passage 120 (FIG. 1) when the valve is closed, and permits fuel flow through the passage when the valve is opened. As shown, the valve 8 is located to control flow through a portion of the fuel circuit that is downstream of the fuel metering assembly and upstream of a main fuel jet that leads into the fuel and air mixing passage. Of course, the valve 8 may be associated with a different portion of the fuel circuit, if desired. By opening or closing the valve 8, the flow rate of fuel to the main fuel jet is altered (i.e. increased when the valve is open) as is the air/fuel ratio of a fuel mixture delivered from the carburetor. A rotary throttle valve carburetor, while not required, may be easily employed because all fuel may be provided to the fuel and air mixing passage from a single fuel circuit, although other carburetors may be used.

In some engine systems, an ignition circuit 38 may provide the power necessary to actuate the solenoid valve 8. A controller 60 associated with or part of the ignition circuit 38 may also be used to actuate the solenoid valve 8, although a separate controller may be used. As shown in FIG. 3, the ignition circuit 38 may include a solenoid driver subcircuit 130 communicated with pin 3 of the controller 60 and with the solenoid at a node or connector 132. The controller may be a programmable device and may have various tables, charts or other instructions accessible to it (e.g. stored in memory accessible by the controller) upon which certain functions of the controller are based.

Figure 4:
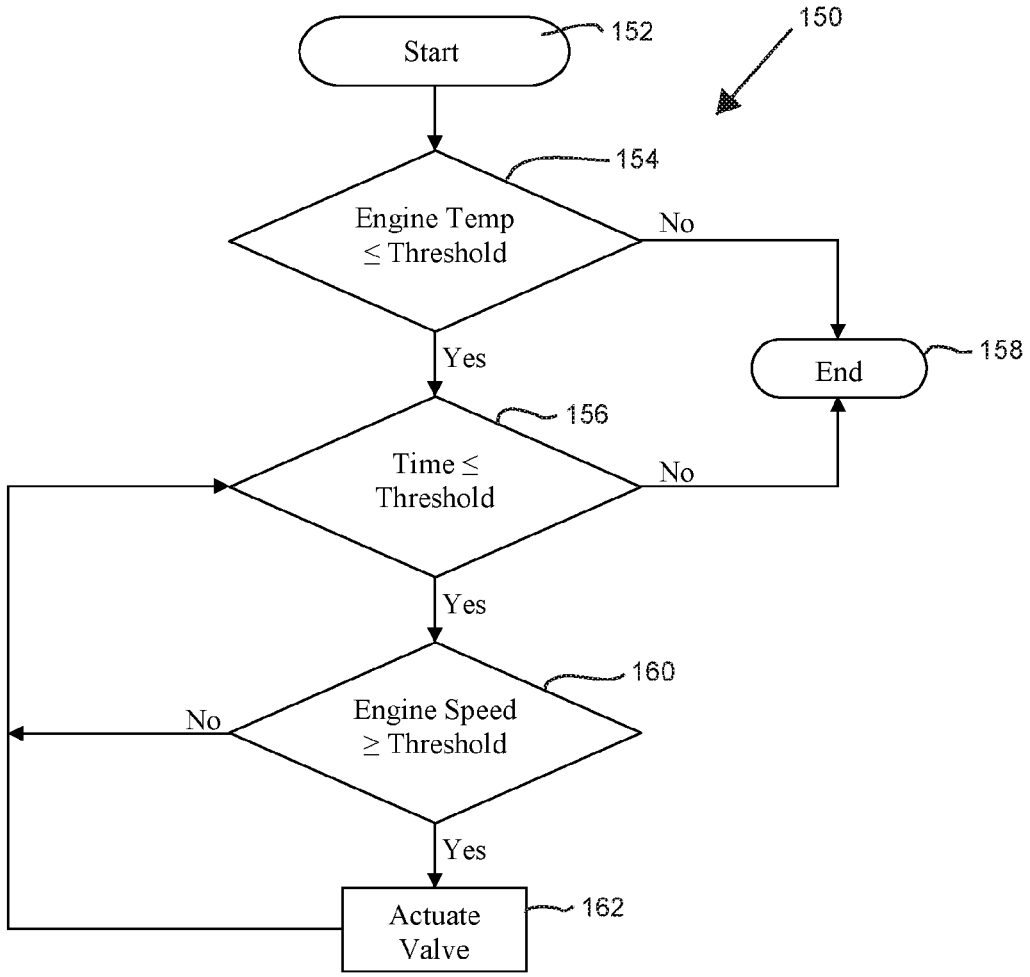
FIG. 4 is a flowchart for an engine control process.

FIG. 4 illustrates an exemplary method 150 for controlling a supply of supplementary fuel for an engine, as discussed in detail below. The method steps may or may not be sequentially processed, and the invention encompasses any sequencing, overlap, or parallel processing of such steps.

At step 152, the method begins in any suitable manner, such as but not limited to, upon starting of the engine or when power sufficient to operate the controller 60 is provided in the circuit 38. During cranking to start the engine and when the engine has been started, the flywheel 12 rotates and electrical power is generated via the magnets 22 and lamstack 30, and the circuit 38 and controller 60 are powered.

At step 154, a temperature associated with the engine is determined. The temperature may be determined in any suitable manner, such as but not limited to, by a temperature sensor that may be part of the circuit 38, carried by the engine, or carried by a part of the tool or device with which the engine is used. The temperature sensed may be the ambient temperature or the temperature of a portion of the engine, carburetor, ignition module or some other part or portion of the tool or device with which the engine is used. The determination may include sensing engine temperature, for instance, using thermal switches, temperature sensors, thermocouples, or any other suitable devices and associated equipment like processors, memory, and the like. When the actual engine temperature, or the temperature of a region suitably close to the engine, is not used, the temperature of the engine may be inferred from the temperature sensed by itself or in combination with other factors, such as time since the engine was last started. Time from the last engine running event may be determined by electrical signal decay in circuit 38 (e.g. by providing controlled drain of charge from charge capacitor 62, and setting threshold as a function of charge level on the charge capacitor 62). In any event, the temperature is sensed and if the temperature is at or below a threshold temperature, the method continues to step 156. If the temperature is above the threshold temperature the method ends at 158.

When the temperature criteria has been satisfied, the method continues at 156 to determine if a time criteria is satisfied. In the example shown, at step 156 it is determined if the time from starting of the engine (which may be determined by when sufficient power is provided to circuit 38 or controller 60) is less than a threshold time. In other words, to satisfy the time criteria of step 156, the engine must not have been started longer ago than a threshold duration of time. The time may be tracked by a counter or clock of the microcontroller 60, or in any other way desired. The time threshold may be a fixed value (e.g. some value between 30 and 200 seconds), or it may correspond to the temperature sensed or determined in step 154. For example, a lower temperature from step 154 may result in a longer time threshold than would a higher temperature. This may permit the warm-up sequence to continue longer when the engine is colder. If the time criteria of step 156 is satisfied, the process continues to step 160.

In step 160, an engine condition, such as engine speed, is checked against a threshold (in this example it is called a speed threshold). Engine speed may be determined in any suitable manner, for example, an engine speed sensor (not shown) may be operatively coupled to the crankshaft, the flywheel, or the like in any suitable manner, or one or more of the lamstack coils may be used to track engine revolutions in any suitable manner, such as by sensing rotation of the magnet past the coil(s). In at least some implementations, the method provides an enriched fuel mixture to the engine only when the engine speed is above a threshold speed (other processes or controls may alter fuel mixture at lower speeds, if and as desired). In at least some implementations, the threshold speed is above idle engine speed, which may include a range of speeds (e.g. 3,200 rpm to 3,600 rpm) or a nominal speed (e.g. 3,400 rpm). The threshold speed may also simply be a lower limit such that any speed above the threshold, up to and including wide open throttle engine operation, may satisfy the speed criteria of step 160. If the engine speed is not greater than the threshold speed, the method starts over, either immediately or after some delay (which may, for example, be based on passage of time, or a number of engine cycles). If the engine speed is greater than the threshold, then the method continues to step 162.

At step 162, the valve 8 is actuated, as desired, to provide supplementary fuel to the engine (via an enriched fuel and air mixture). For example, electrical power is communicated to the electromechanical valve 8 to open the valve 8 and allow fuel to flow from the fuel passage 120 to the air-and-fuel mixing passage 80. Thus, when the engine 2 is relatively cold, has not been operating for longer than a time threshold, and is above a threshold speed, supplementary fuel is provided through the valve 8 and to the engine to facilitate warming up and initial operation of the engine at speeds above the threshold speed.

Figure 6:
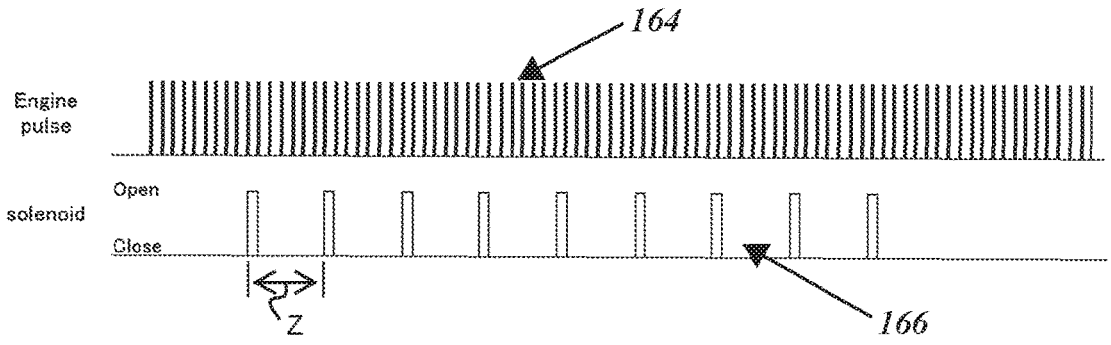
FIG. 6 is a graph showing engine cycles and representative actuation cycles for an electromechanical valve.

In step 162, the valve 8 may be opened and closed according to a desired timing or control signal. The control signal may be time based, or related to the engine cycle and engine speed. For example, the valve 8 may be actuated (opened) for a given number of cycles within a larger number of cycles (e.g. X out of every Y cycles, where X is less than Y. For example, 1 out of every 10 engine cycles or revolutions; or one out of every 100 engine cycles or revolutions). This is generally shown in FIG. 6 wherein engine cycles are diagrammatically shown at 164 and solenoid actuation signal is shown at 166 (and generally shows one solenoid actuation for every 8 engine cycles over engine operation range Z, although that is merely one example). The control signal could also be time based wherein the valve is maintained open for a desired duration of time (e.g. ½ second) and then closed for a desired time (e.g. 2 seconds). The actuation of the valve may be constant for the entire period in which the temperature, time and engine speed criteria are satisfied, or valve actuation may depend upon one or more of the factors. For example, in some implementations, a lower temperature determined in step 154 may cause the valve 8 to be opened more (either more often or for longer duration, and hence, cause more enrichment of the fuel mixture) than would be done with a warmer engine (higher temperature at step 154) to facilitate warming up a colder engine. In some implementations, valve 8 may be opened more the closer in time the valve actuation occurs relative to the engine being started, to provide more enrichment during initial engine operation after starting. In some implementations, a higher engine speed may result in the valve being opened more than a lower engine speed (where the lower speed is still greater than the speed threshold) to help support engine operation at higher speed. Of course, other factors may be used to alter the control signal and these are just a few examples. The control signal criteria may be provided on, in or by a map, look-up table, algorithm or the like, accessible by the microcontroller 60 for implementation within the method 150.

After a desired operation of the valve 8, which may include one or more than one open/close cycle (e.g. range Z may include one or more valve actuations and may extend for a longer period of time or greater number of engine cycles), the method 150 may return to the start 152 so that the engine temperature, time and engine speed criteria are again checked in steps 154, 156 and 160 before further valve actuation is undertaken. Alternatively, the method 150 may return to step 156 so that current conditions are checked against the time and speed thresholds, but the temperature is not checked again. In some implementations, the temperature is determined only once and need not be determined again. In the implementation shown, if either the temperature in step 154 is higher than the temperature threshold or the elapsed time in step 156 since the method was initiated is greater than the time threshold, the method 150 ends and the valve 8 is not actuated. If the speed is below the speed threshold at step 160, however, the method 150 may start over to again check the criteria for valve actuation and fuel mixture enrichment. In this way, the engine speed may exceed the threshold and drop below the threshold more than once within the time threshold and the valve actuation may occur each time the engine speed exceeds the speed threshold within the time threshold, if desired.

Figure 5:
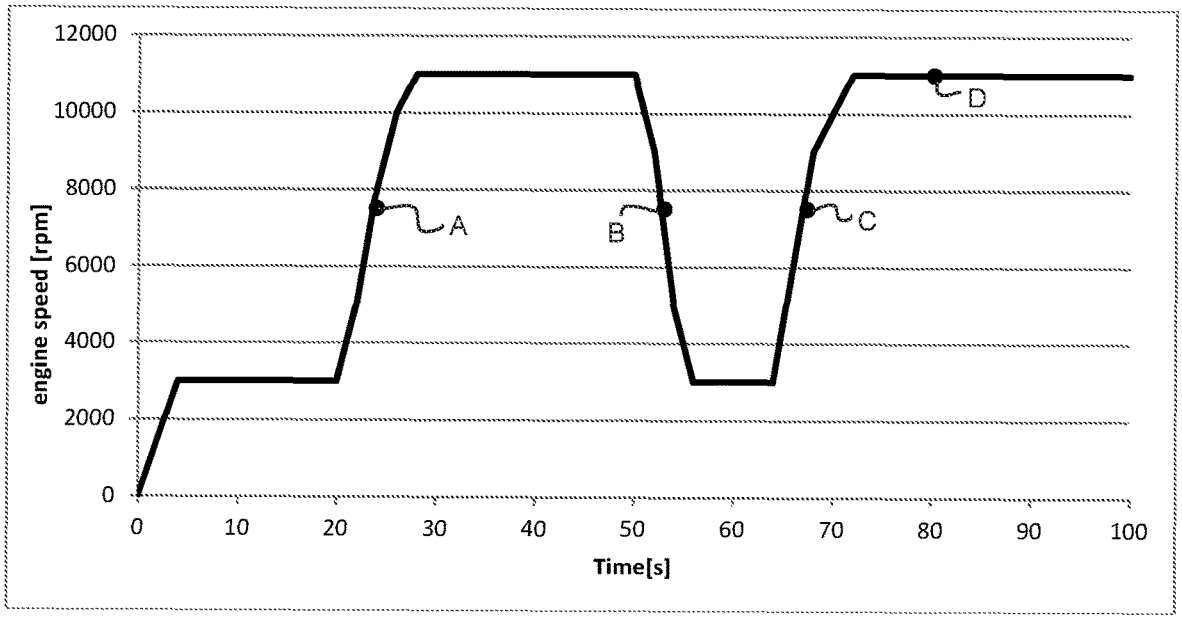
FIG. 5 is a graph of engine speed over time.

FIG. 5 illustrates one implementation of the method 150. In FIG. 5, engine speed in rpm (y-axis) is plotted as a function of time in seconds (x-axis). At time=zero seconds, the engine has just started and the engine speed increases in the first several seconds to about 3,000 rpm, which is the nominal engine idle speed in this example. At time=20 seconds or so, the throttle was actuated and engine speed increased from 3,000 rpm to about 11,000 rpm (which is the wide open throttle engine speed, in this example) between time=20 and time=26 seconds. An engine speed of 11,000 rpm was maintained until time=50 seconds, whereupon the throttle was released, or its amount of actuation decreased, and engine speed dropped back to idle speed over the next six seconds or so. At time=about 64 seconds, the throttle was again actuated and the engine speed increased again to about 11,000 rpm over the next six seconds and that speed was maintained until a time of 100 seconds which is the end of the engine speed plot in FIG. 5.

In this example, the time threshold was set to 80 seconds, the speed threshold was set at 7,500 rpm and an engine starting temperature below the temperature threshold is assumed. Hence, a time of about 23 seconds, when the engine reached 7,500 rpm (point A in FIG. 5), the valve actuation commenced to provide an enriched fuel mixture to the engine. The valve actuation continued until the engine speed decreased below 7,500 rpm, which in the example shown, occurred at about a time of 53 seconds (shown at point B). The valve actuation did not occur between time=53 seconds and time=67 seconds because the engine speed was below 7,500 rpm during that time period. In this example, the valve actuation recommenced at time=67 seconds when the engine speed again reached 7,500 rpm (point C) and the valve actuation continued until time=80 seconds (point D) which was the time threshold in this example. Accordingly, in this example, an enriched fuel mixture was provided to the engine whenever the engine speed was equal to or greater than 7,500 rpm, the time was 80 seconds or less, and the engine temperature was below the threshold value at least when the temperature was first determined after the engine was started (in other words, the temperature may be checked only once, or more than once, during the method, as desired).

In at least some implementations, the speed threshold is at least 25% greater than the engine idle speed (which may be a nominal speed, or an average speed taken over a given duration, e.g. 30 seconds, of idle engine operation) For example, if the engine idle speed is 3,000 rpm, the threshold would be at least 3,750 rpm. And the speed threshold may be at least 100% greater than the idle speed in at least some implementations—for example, with an idle speed of 3,000 rpm, the speed threshold would be 6,000 rpm or higher, as in the example of FIG. 5 in which the speed threshold was 7,500 rpm. Accordingly, the speed threshold may be set somewhere between 25% greater than idle and some speed less than a maximum engine speed, with may implementations falling between about 25% and 200% greater than idle speed.

Further, instead of engine speed, another engine operating condition, such as throttle position, may be determined and checked against a corresponding engine threshold. In such an example, if the throttle valve is open beyond a threshold extent (where the throttle is considered to be increasingly opened between idle and wide open positions), the criteria is considered to be satisfied. The threshold throttle position may be set anywhere between the positions associated with idle and wide open throttle. The throttle position may be checked in combination with engine speed and a combined criteria established for implementation of the method 150, if desired. Still further, an engine stability criteria may also be used either separately or in combination with engine speed and/or throttle position to provide an engine operating criteria within the method 150. Engine stability may be determined by checking cycle-to-cycle speed variations and providing a threshold speed deviation among two or more engine cycles, where a deviation greater than the threshold may be counted and one or more such counts needed to establish an engine instability for which supplementary fuel supply to the engine may be desirable to improve engine stability.

Also, the threshold temperature may be set to any desired value to assist operation of a given engine or engine type. In one implementation, the threshold temperature is 10° C., although other threshold temperatures may be used, for example, between −5° C. and 15° C.

Next, while a time threshold of 80 seconds was used in the FIG. 5 example, the time threshold may be between 10 and 200 seconds (in some implementations, it may be between 60 and 120 seconds), or some other value as desired. Further, the time threshold may be a constant value, or it may depend upon other factor(s), for example, initial engine temperature. For example, the time threshold may be longer when the initial engine temperature is lower (e.g. −15° C.) than when the initial engine temperature is higher (e.g. 5° C.). The colder the engine is, the longer it may take the engine to suitably warm-up and achieve more stable higher speed operation, so the enriched fuel mixture may be provided over a longer time period for a colder engine, if desired. Further, this method may be used in combination with other fuel mixture control strategies, including fuel mixture control at engine idle and for engine acceleration, for example. Such control strategies may be implemented and terminated at speeds lower than the speed threshold and may or might not be subject to the same time threshold. Also, other control strategies may be provided for engine speed above the speed threshold where either or both of the time and temperature criteria are not satisfied such that the method described herein is not also being performed.

In at least some implementations, the method 150 may be used in combination with an idle or lower speed fuel adjustment method that may facilitate warming up an engine operated at speeds lower than the speed threshold of method 150. For example, a lower speed engine warm-up assist method may provide a fuel mixture adjustment (such as but not limited to providing additional or supplementary fuel) at speeds below 6,000 rpm. The low speed method may utilize the same valve 8 and fuel passage 120 arrangement, if desired. And the low speed method may also be temperature and time dependent similarly to the higher speed method 150, with the same or different time and temperature criteria. Accordingly, below a threshold speed, below a threshold temperature and within a time threshold, the low speed method may actuate the valve 8 as desired. In one implementation, the valve is actuated less for a warmer engine (e.g. during one engine cycle for every 150 engine cycles when the engine is at 5° C.) and more for a colder engine (e.g. during one engine cycle for every 40 engine cycles when the engine is at −15° C.).

While the forms of the invention herein disclosed constitute presently preferred embodiments, many others are possible. For example, while supplementary fuel is provided through the valve 8 as noted above, the fuel mixture could be enriched by reducing air flow in addition to or instead of increasing fuel flow. One way to do this is to close off an air passage when the valve is actuated resulting in less air flow to the engine and a higher ratio of fuel to air when the valve is actuated than when the valve is not actuated. Of course, it is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A method of operating a combustion engine, comprising:

comparing a determined temperature, that is equal or related to a temperature of the engine at an engine start, to a temperature threshold;

determining engine speed and comparing the engine speed to a threshold speed;

determining if a time since the engine was started is less than a threshold time, where the threshold time is set as a function of the determined temperature; and if the determined temperature is below the threshold temperature and the engine speed is above the threshold speed, and the time since the engine was started is less than the threshold time, providing an enriched fuel and air mixture to the engine.

2. The method of claim 1 wherein the threshold speed includes an engine speed that is at least 1,000 rpm greater than a nominal idle speed of the engine.

3. The method of claim 1 wherein the threshold speed includes an engine speed that is between 3,500 rpm and wide open throttle engine operation.

4. The method of claim 1 wherein the threshold speed includes an engine speed that is at least 25% greater than a nominal idle speed of the engine.

5. The method of claim 1 wherein the threshold time is between 10 and 200 seconds.

6. The method of claim 1 wherein the step of providing an enriched fuel and air mixture includes opening a valve associated with a charge forming device to provide additional fuel into a fuel and air mixture provided from the charge forming device than is provided when the valve is closed.

7. The method of claim 6 wherein the valve is selectively opened and closed during the threshold time when the engine speed is greater than a speed threshold.

8. The method of claim 1 wherein the step of providing an enriched fuel and air mixture includes closing a valve associated with an air passage to reduce air within a fuel and air mixture delivered to the engine.

9. The method of claim 1 which also includes the step of providing an enriched fuel and air mixture to the engine when the engine speed is below a speed threshold and the time since the engine was started is less than a warm-up time threshold.

10. The method of claim 1 wherein the threshold temperature is between −5° C. and 15° C.

11. The method of claim 1 wherein the step of providing an enriched fuel and air mixture to the engine is accomplished as a function of at least one of the time since the engine was started and the difference between the determined temperature and the threshold temperature.

12. The method of claim 1 wherein the fuel and air mixture is provided to the engine by a charge forming device having a throttle valve and wherein the engine threshold relates to the position of the throttle valve relative to a position of the throttle valve when the engine is operating at a nominal engine idle speed.

13. The method of claim 1 which also includes determining cycle-to-cycle engine speed deviation and providing an enriched fuel and air mixture to the engine when the determined cycle-to-cycle engine speed deviation is greater than a maximum cycle-to-cycle engine speed deviation.

14. The method of claim 1 wherein the threshold time is between 10 and 200 seconds and the threshold temperature is between −5° C. and 15° C.

15. A method of operating a combustion engine, comprising:

determining a temperature equal or related to a temperature of the engine at an engine start and comparing the determined temperature to a temperature threshold;

determining if an engine operating condition exceeds an engine threshold within a threshold time after the engine was started; and if the determined temperature is below the threshold temperature and the engine operating condition remains above the engine threshold and the threshold time has not passed, providing an enriched fuel and air mixture to the engine, wherein the step of providing an enriched fuel and air mixture includes opening a valve associated with a charge forming device to provide additional fuel into a fuel and air mixture provided from the charge forming device than is provided when the valve is closed, wherein the valve is selectively opened and closed during the threshold time when the engine speed is greater than a speed threshold, and wherein the valve is repeatedly opened for a first period of time and closed the remainder of the time within the threshold time.

16. The method of claim 15 wherein the valve is open for at least 10 percent of the engine revolutions within the threshold time.

17. The method of claim 15 wherein the first period of time includes one or more engine revolutions and the second period of time includes a greater number of engine revolutions than the first period of time.

18. The method of claim 17 wherein the valve is open for at least 1 revolution out of every 10 to 100 revolutions.

* * * * *